US005829910A

United States Patent [19]

Kameyama

[11] Patent Number: 5,829,910

[45] Date of Patent: Nov. 3, 1998

[54] MOVABLE CONNECTING CONSTRUCTION

[75] Inventor: Isao Kameyama, Shizuoka, Japan

[73] Assignee: Yazaki Corporation, Tokyo, Japan

[21] Appl. No.: 808,219

[22] Filed: Feb. 28, 1997

[30] Foreign Application Priority Data

Feb. 28, 1996 [JP] Japan ..... 8-041107

[51] Int. Cl.[6] ..... B25G 3/18

[52] U.S. Cl. ..... 403/329; 403/326; 403/328; 403/348; 24/572; 24/573.1; 411/508; 439/701; 439/364

[58] Field of Search ..... 403/326, 328, 403/329, 315, 319, 13, 14; 24/289, 297, 588, 573.1, 572; 411/508, 509, 510, 913, 338, 339; 439/364, 701, 247, 248

[56] References Cited

U.S. PATENT DOCUMENTS

| | | | |
|---|---|---|---|
| 4,261,151 | 4/1981 | Ito | 24/573.1 X |
| 4,422,222 | 12/1983 | Notoya | 24/289 X |
| 4,909,748 | 3/1990 | Kozono et al. | 439/247 |
| 4,921,435 | 5/1990 | Kane et al. | 439/247 X |
| 5,336,104 | 8/1994 | Nagamine | 439/364 |
| 5,480,322 | 1/1996 | Ishii et al. | 439/364 X |
| 5,620,329 | 4/1997 | Kidd et al. | 439/248 |
| 5,671,513 | 9/1997 | Kawahara et al. | 24/573.1 |

FOREIGN PATENT DOCUMENTS

| | | |
|---|---|---|
| 64-27982 | 2/1989 | Japan . |
| 5-61908 | 8/1993 | Japan . |

*Primary Examiner*—Daniel P. Stodola
*Assistant Examiner*—Bruce A. Lev
*Attorney, Agent, or Firm*—Sughrue, Mion, Zinn, Macpeak & Seas, PLLC

[57] ABSTRACT

First resilient portions (21) having a radially-acting resilient force, as well as second resilient portions (23) having an axially-acting resilient force, are provided on a support member (2). A connection member (1) has a fitting portion (4) for receiving the support member, and the fitting portion has retaining portions (12) for the resilient portions (21). The resilient portions (21) contact an inner surface of the fitting portion (4), and the resilient portions (24) are abutted against the fitting portion. Guide grooves (20) are formed respectively in four side surfaces of the support member (2), and the resilient piece portion (21) is provided in each of the guide grooves, and projects rearwardly, and the resilient arms (23) are formed on the outer surface of the support member, and project forwardly. The retaining pawls (12) are formed on an open end (11) of the fitting portion, and each of the retaining pawls is received in the associated guide groove (20) to be engaged with the associated resilient piece portion (21), and elongate projections (10) each for contact with the associated resilient piece portion (21) are formed on the inner surface of the fitting portion. The connection member is either a frame for receiving a plurality of connectors or a connector, and the connection member, fitted on the support member (2) mounted on the panel, can be fitted in a mating frame or a mating connector (39), which is fixed to another panel.

4 Claims, 6 Drawing Sheets

MOVABLE CONNECTING CONSTRUCTION

BACKGROUND OF THE INVENTION

1. Field of the Invention

This invention relates to a movable connecting construction which absorbs a misregistration in directions of three dimensions when connecting a connector or the like, thereby enabling a positive connection.

2. Related Art

FIG. 9 shows a conventional movable connector described in Japanese Utility Model Unexamined Publication No. 64-27982.

In this movable connector 41, loop-shaped spring portions 43, together with a support flange 44, are integrally formed on a connector housing 42 of a synthetic resin, and project beyond four sides of the connector housing 42, respectively, the support flange 44 projecting less than the spring portions 43. The support flange 44 is fitted in a guide groove 46 in a panel 45 of a vehicle, so that the housing portion 42 is movable right, left, up and down because of the resiliency of the spring portions 43. The panel 45 can be divided into upper and lower portions, and the two portions are joined together when mounting the connector on the panel.

Because of the movability of the connector, even if this connector is misaligned with a mating connector (not shown), this misalignment can be absorbed, so that the connectors can be fitted together smoothly.

In the above conventional movable connector 41, however, as the size of the connector increases with an increased number of terminals, the size of the spring portions 43 increases, so that a larger space is required for mounting the connector on the panel 45. However, the mounting space in the vehicle is limited, and therefore it has often been difficult to mount the connector 41. And besides, since the spring portions 43 are provided around the outer periphery of the connector 41, the spring portions 43 have often been stricken against the panel 45 to be deformed or damaged when mounting the connector on the panel 45. Furthermore, since the loop-shaped spring portions 43 must be fitted in the guide groove 46, and must be held in position by the panel 45, the mounting operation is cumbersome, and therefore much time and labor have been required.

SUMMARY OF THE INVENTION

With the above problem in view, it is an object of this invention to provide a movable connecting construction in which an increased size of a connection member, such as a connector, due to the provision of spring portions, is prevented, and deformation, etc., of the spring portions due to interference with an external member is eliminated, and the movable connecting construction can be easily mounted on a panel.

The above object of the invention has been achieved by a movable connection construction characterized by the provision of a support member for being fixed to a panel, and a connection member for fitting on the support member, wherein first resilient portions, having a radially-acting resilient force, are provided on the support member in adjacent relation to a front end of the support member; second resilient portions, having an axially-acting resilient force, are provided on the support member in adjacent relation to a rear end of the support member; the connection member has a fitting portion for receiving the support member therein; retaining portions for the first resilient portions are provided in the fitting portion; and the first resilient portions can contact an inner surface of the fitting portion, and the second resilient portions can be abutted against a front end of the fitting portion.

In the above construction, a guide groove is formed in each of four side surfaces of the support member, and extends in an axial direction, and a resilient piece portion, serving as the first resilient portion, is provided in each of the guide groove, and projects toward the rear end of the support member, and resilient arms, serving as the second resilient portions, are formed on the side surfaces, and project toward the front end of the support member, and retaining pawls, serving as the retaining portions, are formed on an open end of the fitting portion, and each of the retaining pawls can be received in the associated guide groove to be engaged with the associated resilient piece portion, and elongate projections each for contact with the associated resilient piece portion are formed on the inner surface of the fitting portion.

The connection member is either a frame for receiving a plurality of connectors or a connector, and the connection member, fitted on the support member mounted on the panel, can be fitted in a mating frame or a mating connector, which is fixed to another panel.

The operation will be described below.

The support member is fixed to one panel, and the mating frame or the mating connector is fixed to the other panel. The connection member is supported through the first resilient portions on the support member so as to move up, down, right and left, and also is supported through the second resilient portions so as to move back and forth. When connecting the mating frame or the mating connector to the support member, misalignment is absorbed by the first resilient portions, and variations in the dimension between the two panels are absorbed by the second resilient portions. The guide grooves in the support member allow the retaining pawls of the connection member to smoothly move to the resilient piece portions without resistance.

BRIEF DESCRIPTION OF THE PREFERRED EMBODIMENTS

DETAILED DESCRIPTION OF THE PREFERRED EMBODIMENTS

A preferred embodiment of the present invention will now be described in detail with reference to the drawings.

FIGS. 1 to 7 show one preferred embodiment of a movable connecting construction of the invention.

Figure 1:
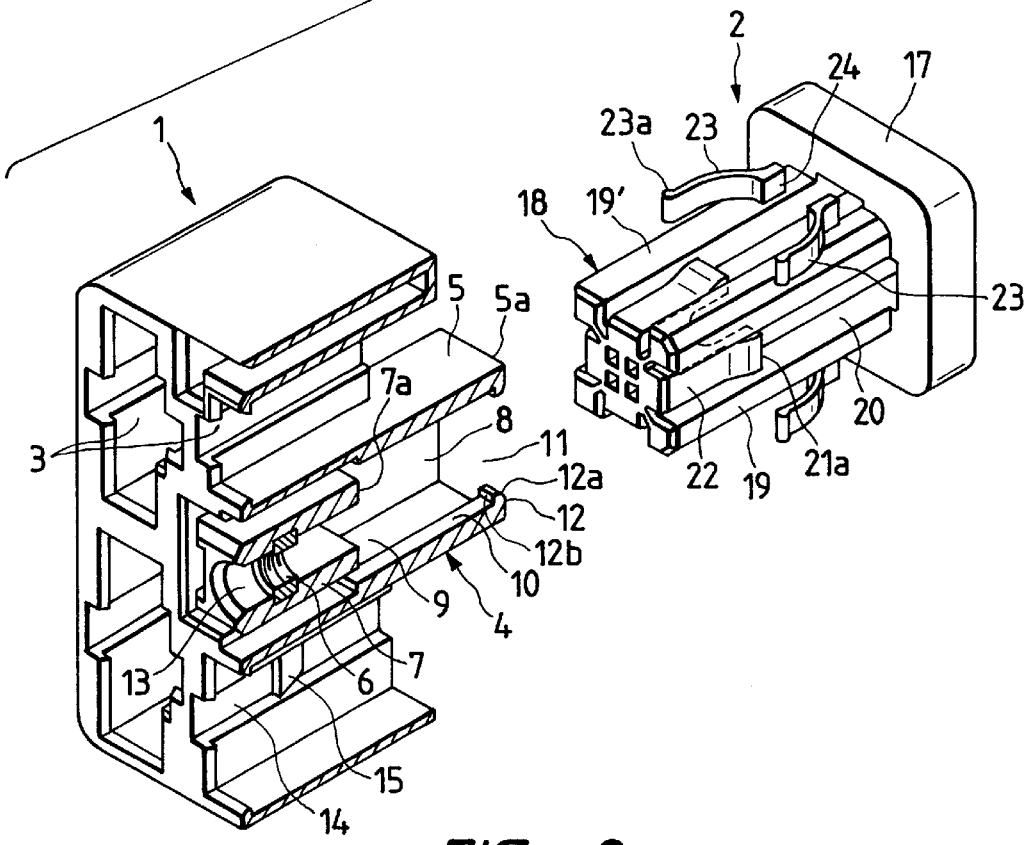
FIG. 1 is an exploded, perspective view of one preferred embodiment of a movable connection construction of the present invention.

As shown in FIG. 1, this movable connecting construction comprises a connector holding frame (connection member) 1 made of a synthetic resin, and a support member 2 inserted and engaged in a central portion of the holding frame 1.

The frame 1 is of a generally rectangular box-shape, and includes a plurality of connector receiving chambers 3 formed through an outer peripheral portion thereof, and a rectangular, tubular fitting portion 4 formed at its central portion for receiving the support member 2. The fitting portion 4 includes a rectangular, tubular wall portion 5 which is formed integrally with the frame 1, and projects forwardly toward the support member. A base wall 7, having a nut 6, is formed within a rear half portion of the fitting portion 4, and a fitting chamber 8 is defined by that portion of the interior of the fitting portion 4 extending from a front end 7*a* of the base wall 7 to a front end of the tubular wall portion 5.

An elongate projection 10 is formed on each inner surface 9 of the fitting chamber 8, and extends in a longitudinal direction (that is, a direction of the fitting axis), the elongate projection 10 being disposed centrally of the width of the inner surface 9 of the fitting chamber 8. A retaining pawl (retaining portion) 12 for retaining the support member 2 is formed at a front end of each elongate projection 10, that is, at an edge portion of an open end 11 of the tubular portion 5. The retaining pawl 12 has an inclined guide surface 12*a* formed at its front side, and also has a perpendicular (vertical) abutment surface 12*b* formed at its rear side. A bolt hole 13 is formed through the base wall 7, and the nut 6 is fixedly secured at a central portion of the bolt hole 13. This arrangement is used to secure a mating connection member (not shown) to the left side of connection member 1 using a bolt received in bolt hole 13 and threadedly engaged with the nut 6. A retaining pawl 15 for retaining a connector (described later) is formed on an inner surface 14 of each connector receiving chamber 3.

The support member 2 includes a flange portion (base plate portion in the form of a rectangular plate) 17 adapted to be fixed to a body panel 16 (FIG. 2) of a vehicle, and a support post portion (insertion portion) 18 of a generally rectangular shape extending perpendicularly from a central portion of the flange portion 17. A guide groove 20 for engagement with the associated elongate projection 10 is formed in each side surface 19 of the support post portion 18, and extends along a length thereof, the guide groove 20 being disposed centrally of the width of the side surface 19. A resilient piece portion (first resilient portion) 21 for contact with the associated elongate projection 10 is provided in the guide groove 20 in adjacent relation to a front end of the support post portion 18, and projects toward the flange portion 17. The resilient piece portion 21 has a resilient force acting radially of the support post portion 18, and has at its distal end an abutment surface 21*a* for engagement with the associated retaining pawl 12. In the guide groove 20, the resilient piece portion 21 extends to the distal end of the support post portion 18 through a protuberance 22. The protuberance 22 is disposed slightly outwardly of the guide groove 20.

A pair of arcuately-curved resilient arms (second resilient portions) 23 are formed on each of the upper and lower side surfaces 19' of the support post portion 18 in adjacent relation to the rear or proximal end thereof, the resilient arms 23 projecting toward the front or distal end of the support post portion 18. The resilient arms 23 have a resilient force acting in the direction of the fitting axis. Each pair of resilient arms 23 and 23 are curved outwardly, and extend outwardly beyond the width-of the side surface 19', and each resilient arm 23 has a cylindrical distal end 23*a* of a circular cross-section.

Proximal end portions of each pair of resilient arms 23 merge respectively to a pair of ear-like support portions 24 which are formed on the side surface 19', and are disposed respectively on the opposite sides of the guide groove 20. The distance between the distal ends of the pair of resilient arms 23 and 23 is substantially equal to the width of the rectangular, tubular wall portion 5, and the distal ends 23*a* of the arms 23 are positioned in opposed relation to the distal end of the tubular wall portion 5. Each resilient arm 23 is slidable over the front or distal end 5*a* of the rectangular, tubular wall portion 5. The resilient piece portions 21, the resilient arms 23 and the support post portion 18 are molded into an integral construction, using a synthetic resin.

FIGS. 2 to 6 show the operation of the above movable connecting construction.

Figure 2:
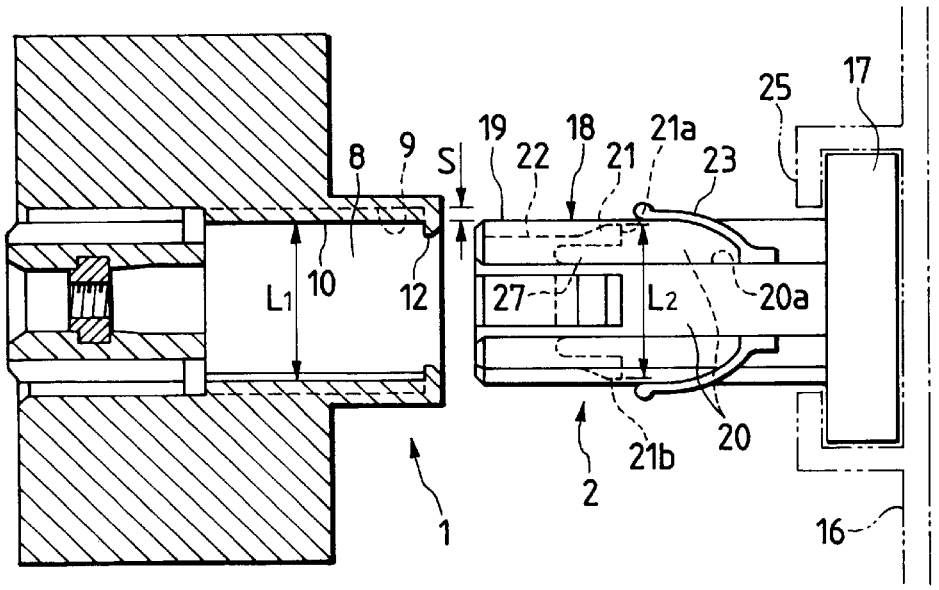
FIG. 2 is a vertical cross-sectional view showing a condition in which a connection member (frame) is to be fitted on a support member.
Figure 9:
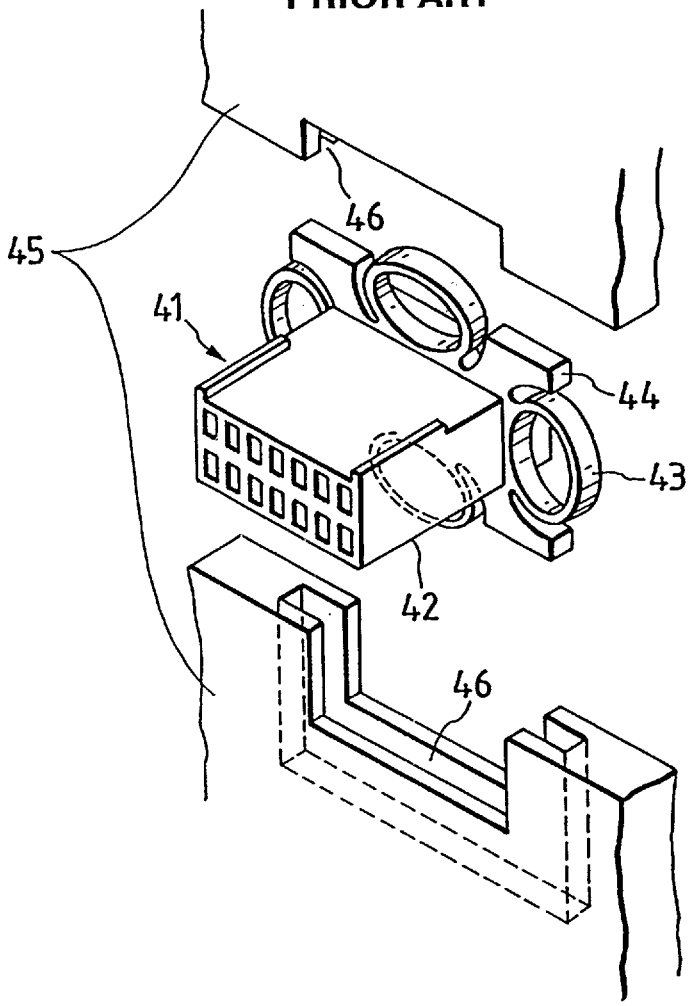
FIG. 9 PRIOR ART
FIG. 9 is an exploded, perspective view of a conventional construction.

In FIG. 2, the flange portion 17 of the support member 2 is, for example, slidingly engaged with a pair of guide projections 25 on the body panel 16, and is fixed thereto. With this arrangement, there is no need to form a hole in the body panel 16. The reason for this is that any resilient portion as used in the conventional construction is not formed on the flange portion 17. Since no resilient portion is formed on the flange portion 17, there is no possibility that the resilient portions are damaged when mounting this construction on the panel 16, and besides the mounting operation can be effected easily. Of course, the flange portion can be engaged in a guide groove in a split-panel as in the conventional construction (FIG. 9). The support member 2 is fitted in the frame 1, and in this condition the frame 1 can be fitted relative to a mating frame 26 (FIG. 7) fixedly mounted on an instrument panel.

A certain degree of gap S is formed between the outer peripheral surface 19 of the support post portion 18 of the support member 2 and the inner peripheral surface 9 of the fitting chamber 8 in the frame 1. Within the range of this gap S, the frame 1 is movable up, down, right and left relative to the support member 2. The distance $L_1$ between the opposed elongate projections 10, formed on the inner peripheral surface 9, is substantially equal to the distance $L_2$ between the oppositely-disposed resilient piece portions 21, and an outer side 21*b* of the distal end of each resilient piece portion 21 can contact the surface of the associated elongate projection 10. The distance between the oppositely-disposed protuberances 22 (each serving as the proximal end portion of the associated resilient piece portion 21), provided in the respective guide grooves 20, is slightly smaller than distance between the opposed retaining pawls 12, and the protuberance 22 can slide relative to the associated retaining pawl 12. A flexure space 27 is formed between the resilient piece portion 21 and the bottom surface of the associated guide groove 20.

Figure 3:
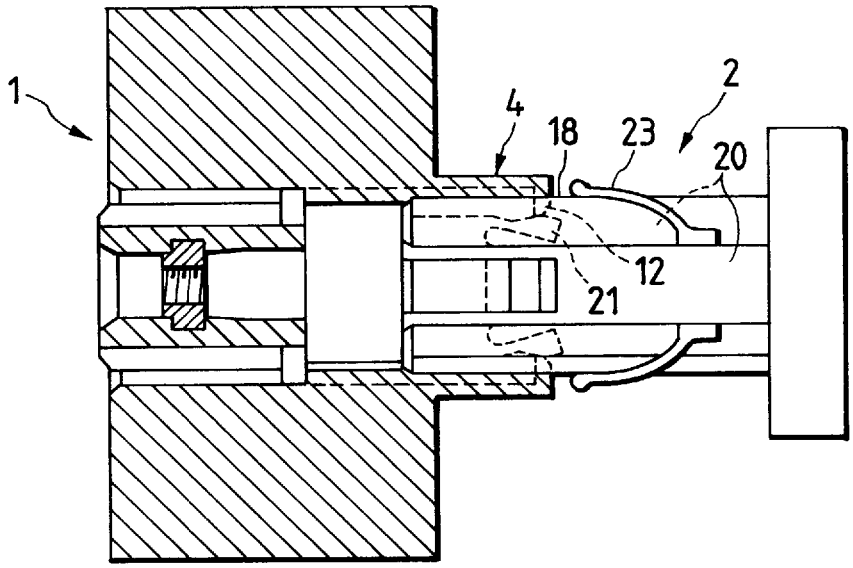
FIG. 3 is a vertical cross-sectional view showing a condition during the fitting operation.
Figure 4:
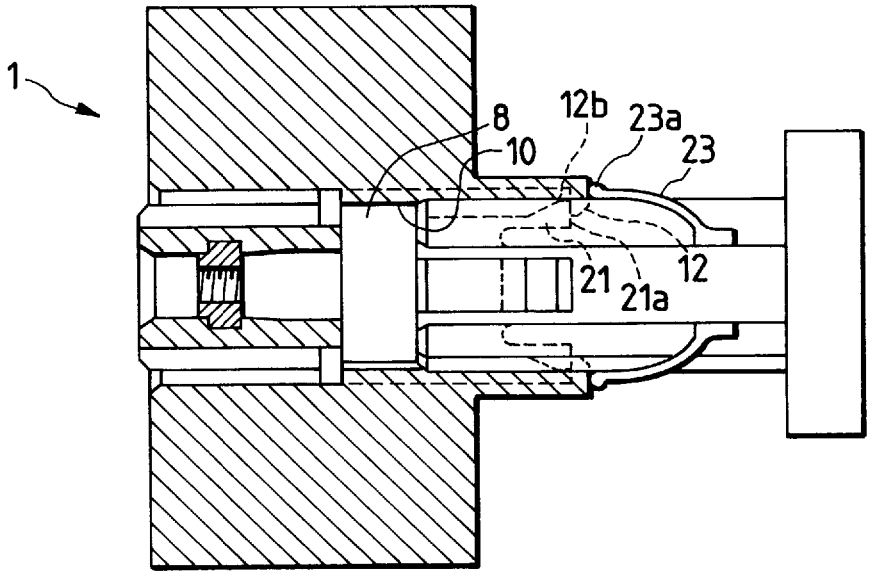
FIG. 4 is a vertical cross-sectional view showing a provisionally-fitted condition.

FIGS. 3 and 4 show a condition in which the frame 1 is moved toward the support member 2, with the support post portion 18 of the support member 2 fitted in the fitting portion 4 in the frame 1. Each resilient piece portion 21 is flexed inwardly in the guide groove 20 by the associated retaining pawl 12, and then is restored when it passes past the retaining pawl 12, so that the abutment surface 21*a*, formed at the distal end of the resilient piece portion 21, is abutted against the rear surface 12*b* of the retaining pawl 12, and also the resilient piece portion 21 is held in contact with the inner surface of the fitting chamber 8 (that is, in contact with the elongate projection 10), as shown in FIG. 4. At the same time, the distal ends 23*a* of the resilient arms 23 are abutted against the front end 5*a* of the tubular wall 5 of the fitting portion 4. The resilient arms 23 are kept in a slightly contracted, flexed condition.

Figure 5:
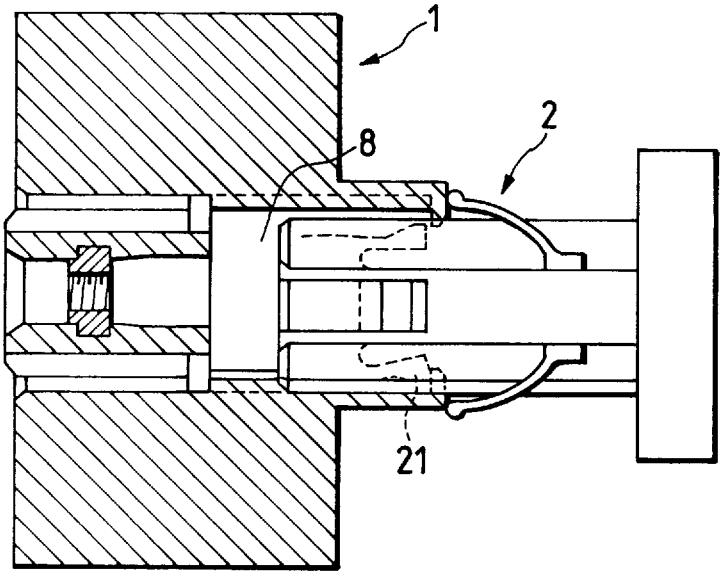
FIG. 5 is a vertical cross-sectional view showing a condition in which the connection member is displaced radially.

As shown in FIG. 5, the resilient piece portions 21 can be flexed within the fitting chamber 8, and therefore the frame 1 can be displaced up, down, right and left relative to the support member 2 within the range of flexing of the resilient piece portions 21. With this arrangement, misalignment of the frame 1 relative to the mating frame 26 (FIG. 7) can be absorbed. The resilient piece portions 21, after flexed, are restored by a reaction force to thereby locate the frame 1 in position.

Figure 6:
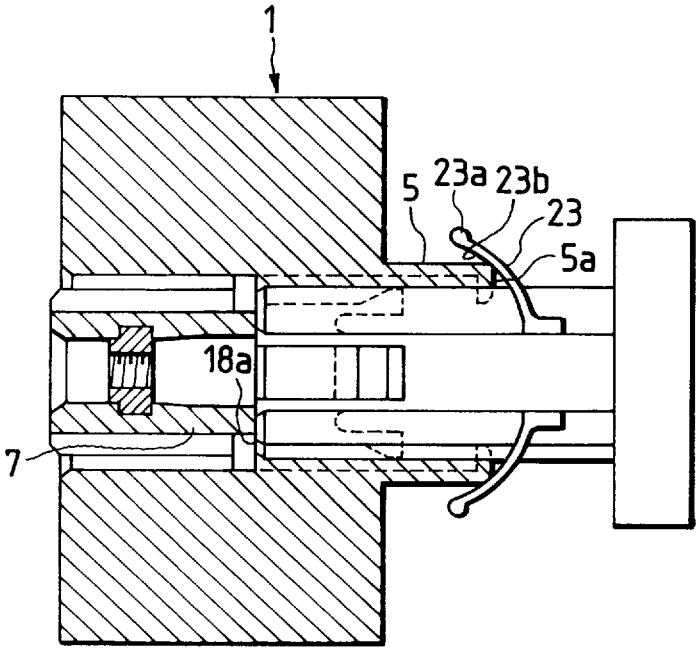
FIG. 6 is a vertical cross-sectional view showing a condition in which the connection member is displaced in a direction of the fitting axis.

When the instrument panel (not shown) is attached to the body panel 16, the two frames 1 and 26 are fitted together. When there are variations in the distance between the instrument panel and the body panel 16, the frame 1 can be moved back and forth within the range of flexing of the resilient arms 23, as shown in FIG. 6. The cross-sectionally circular distal end 23*a* of each resilient arm 23 can be easily displaced outwardly out of engagement with the front end 5*a* of the rectangular, tubular wall 5, so that the front end 5*a* is brought into sliding contact with an inner surface 23*b* of the resilient arm 23, thereby moving the resilient arm 23 outwardly against its spring force. When a front end 18*a* of the support member 2 is brought into engagement with the base wall 7 within the frame 1, the support member 2 is stopped. The frame 1 is urged rearwardly (in a direction opposite to the fitting direction) by the spring force of the resilient arms 23, and therefore is prevented from shaking.

The condition of FIG. 6 develops when the mating frame 26 is pressed against the frame 1 so that the two frames can be fitted together by a bolt 30, and when this load is removed, the frame 1 is returned to its initial position by the reaction force produced by the resilient arms 23.

Figure 7:
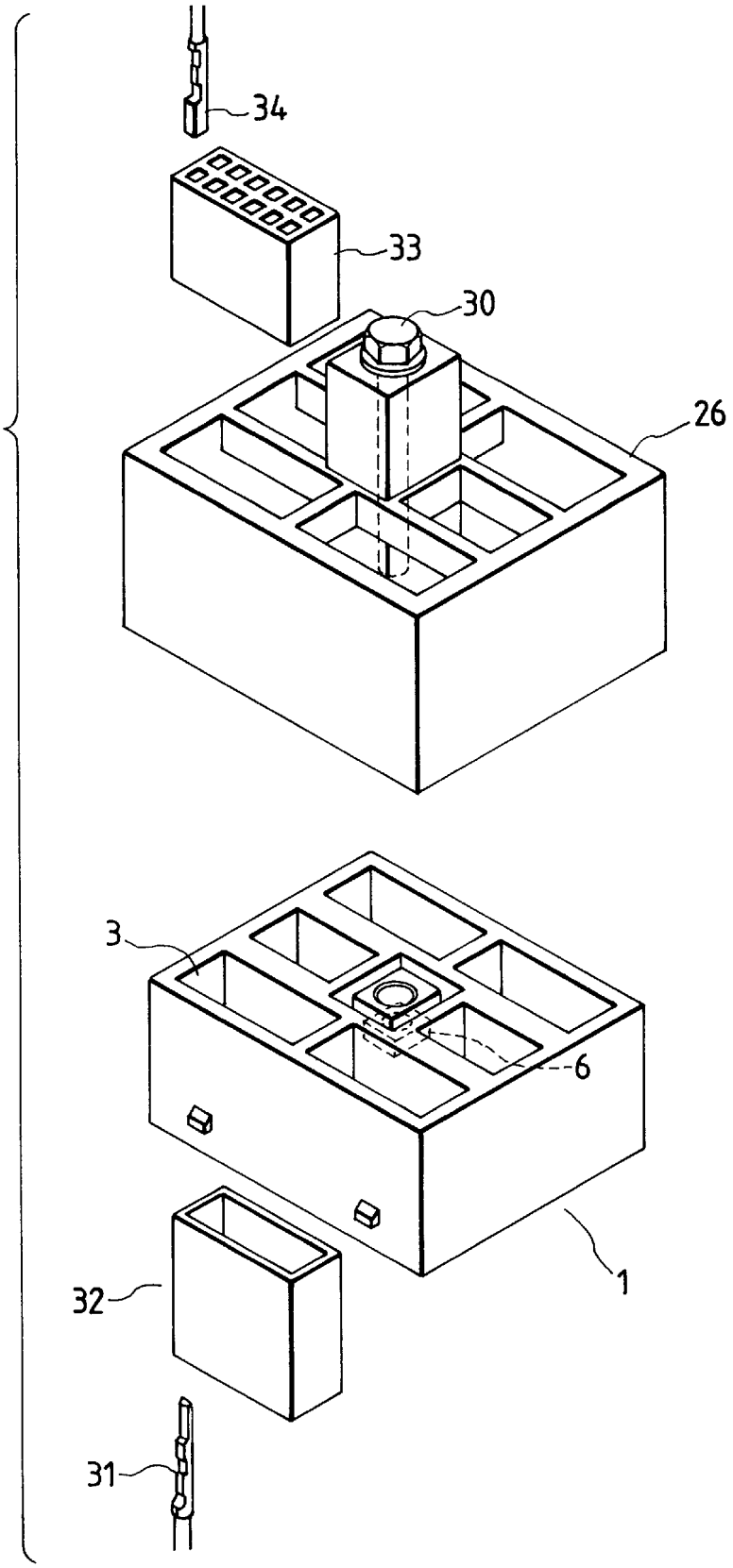
FIG. 7 is an exploded, perspective view showing a frame-fitting construction.

FIG. 7 shows the connection construction for the frame 1.

A plurality of female connectors 32, each having male terminals 31 received therein, are inserted respectively into the connector receiving chambers 3 in the male frame 1. A plurality of male connectors 33 are inserted into the female frame 26 mounted on the instrument panel, and in this condition the female frame 26 is fitted on the male frame 1. Female terminals 34 are received in each male connector 33, and when the two frames 1 and 26 are fitted together, the male connectors 33 are fitted respectively in the female connectors 32. The bolt 30 is rotatably mounted on the female frame 26, and the bolt 30 is threaded into the nut 6 in the male frame 1, thereby fitting the two frames 1 and 26 together. The above embodiment is directed to the multi-pole, split connector in which the plurality of connectors 32 each having the plurality of terminals 31 can be fitted to the respective connectors 33, each having the plurality of terminals 34, at the same time.

Figure 8:
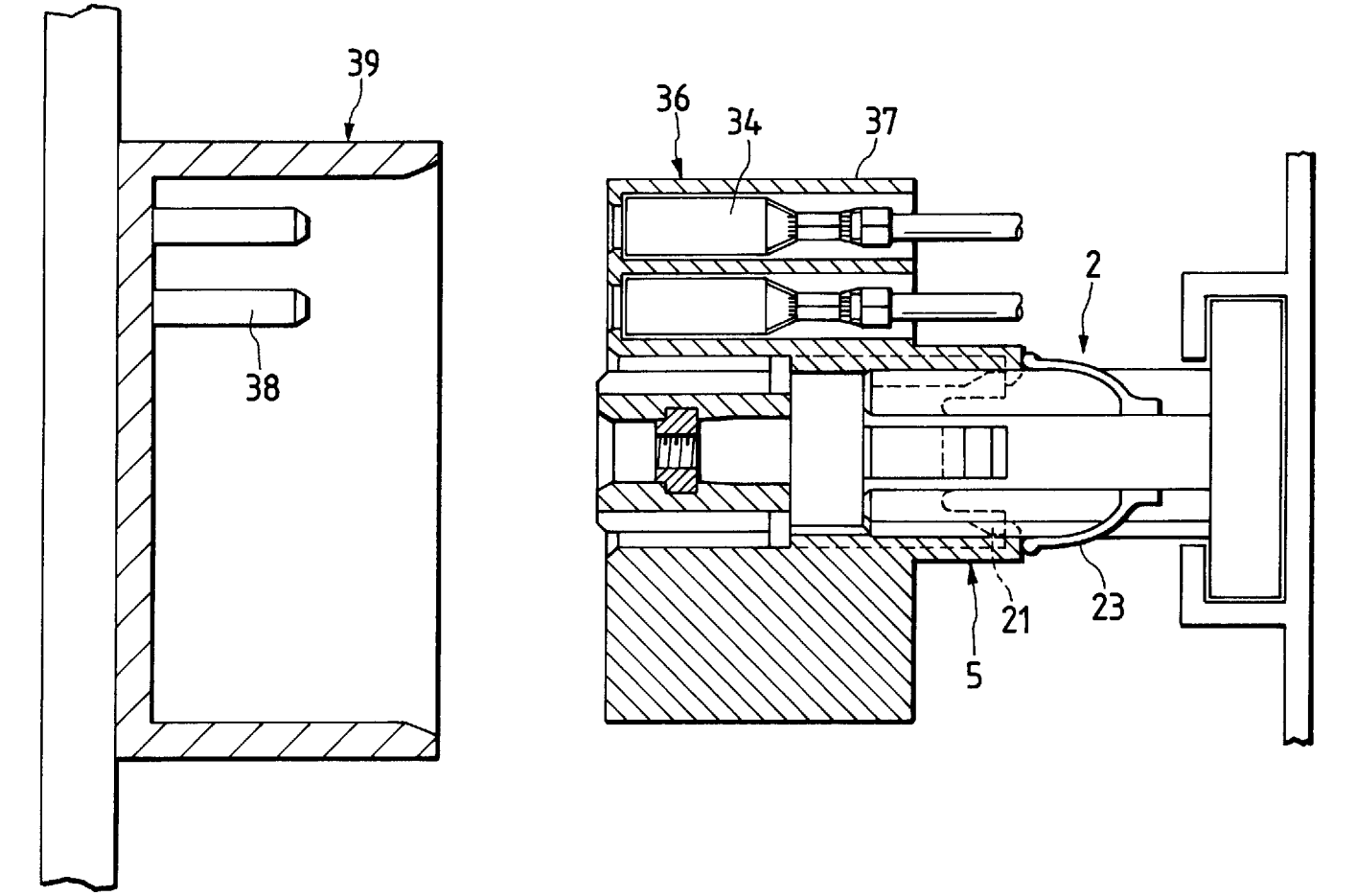
FIG. 8 is a vertical cross-sectional view of another embodiment in which a connector is used as a connection member.

FIG. 8 shows another embodiment in which a pair of male and female connectors are fitted together using a movable mechanism similar to the above-mentioned movable mechanism.

More specifically, a fitting portion 5 for receiving a support member 2 is formed in a central portion of a male connector housing 37 (made of a synthetic resin) of the male connector (connection member) 36 having female terminals 34 received therein. The mating female connector 39, having male terminals 38, is fixedly mounted on an instrument panel. In this embodiment, misalignment of the male connector 36 relative to the female connector 39 can be absorbed by resilient piece portions 21, and also, misregistration between the two connectors 36 and 39 in a forward-rearward direction can be absorbed by resilient arms 23, thereby enabling the two connectors to be connected together smoothly and positively.

In the above embodiments, those portions (the support post portion 18 and the misregistration absorbing mechanism) other than the flange portion 17 can be formed on the frame 1 or the connector 36 while the fitting portion 5 for the misregistration absorbing mechanism can be formed on the support member 2. Also, the resilient arms 23 may be replaced by loop-shaped or S-shaped resilient portions.

Advantageous Effects of the Invention

As described above, in the present invention, the first resilient portions, which allow the connection member, such as the connector-holding frame or the connector, to move in all (four) directions, are provided inside (that is, in the central portion) the connection member, and are constituted respectively by the space-saving, resilient piece portions. Therefore, the connection member can be formed into a small size, and even if the connection member is a multi-pole connector, its outer diameter is generally equal to that of a connector without the movable mechanism, and this structure can be positively mounted even in a narrow mounting space. And besides, because of the provision of the second resilient portions, the connector member is movable back and forth, and therefore for example, even if there is variations in the spacing between the body panel and the instrument panel, the dimensional error is absorbed, so that the connectors can be positively connected together. Furthermore, since no resilient portion is provided on the panel-mounting portion (flange portion) of the support member, the mounting of this structure on the panel can be effected easily, and the resilient portions will not be damaged during the mounting operation.

What is claimed is:

1. A movable connection structure comprising:

a support member fixed to a panel, said support member including:

first resilient portions, having a transversely acting resilient force acting in a transverse direction, integrally provided on said support member in adjacent relation to a front end of said support member;

second resilient portions, having an axially-acting resilient force acting in an axial direction, integrally provided on said support member in adjacent relation to a rear end of said support member;

a connection member fitting on said support member, said connection member being separate from said panel and mateable with a mating connection member, said connection member including:

a fitting portion for receiving said support member therein; and retaining portions, for retaining said first resilient portions, provided in said fitting portion;

wherein said first resilient portions contact an inner surface of said fitting portion to allow for relative movement between said connection member and said support member in said transverse direction, and said second resilient portions contact a front end of said fitting portion to allow relative movement of said connection member and said support member in said axial direction.

2. A movable connection structure according to claim 1 wherein said connection member is one of a frame for receiving a plurality of connectors and a connector, and said connection member, fitted on said support member mounted on said panel, is fitted in one of a mating frame and a mating connector, which is fixed to another panel.

3. A movable connection structure comprising:

a support member fixed to a panel, said support member including:

first resilient portions, having a radially-acting resilient force, provided on said support member in adjacent relation to a front end of said support member;

second resilient portions, having an axially-acting resilient force, provided on said support member in adjacent relation to a rear end of said support member;

a connection member fitting on said support member, said connection member including:

a fitting portion for receiving said support member therein; and retaining portions, for retaining said first resilient portions, provided in said fitting portion;

wherein said first resilient portions contact an inner surface of said fitting portion, and said second resilient portions can be abutted against a front end of said fitting portion;

a guide groove formed in each of four side surfaces of said support member, and extending in an axial direction;

a resilient piece portion, serving as said first resilient portion, provided in each of said guide groove, and projecting toward the rear end of said support member;

resilient arms, serving as said second resilient portions, formed on said side surfaces, and projecting toward the front end of said support member;

retaining pawls, serving as said retaining portions, formed on an open end of said fitting portion, and each of said retaining pawls received in the associated guide groove to be engaged with the associated resilient piece portion; and elongate projections each for contact with the associated resilient piece portion formed on the inner surface of said fitting portion.

4. A movable connection structure according to claim 3 wherein said connection member is one of a frame for receiving a plurality of connectors and a connector, and said connection member, fitted on said support member mounted on said panel, is fitted in one of a mating frame and a mating connector, which is fixed to another panel.

* * * * *